US010683652B1

(12) United States Patent
Beach et al.

(10) Patent No.: US 10,683,652 B1
(45) Date of Patent: Jun. 16, 2020

(54) MULTIPLE RINSE INJECTIONS TO REDUCE SOUND IN VACUUM TOILETS

(71) Applicant: MAG Aerospace Industries, LLC, Carson, CA (US)

(72) Inventors: David Beach, Los Alamitos, CA (US); Kent Gee, Provo, UT (US); John Yu, Diamond Bar, CA (US); Scott Sommerfeldt, Mapleton, UT (US); Garen Murray, Lakewood, CA (US); Razmik Boodaghians, Glendale, CA (US); David Ji Chun Kim, Buena Park, CA (US)

(73) Assignee: MAG Aerospace Industries, LLC, Carson, CA (US)

( * ) Notice: Subject to any disclaimer, the term of this patent is extended or adjusted under 35 U.S.C. 154(b) by 38 days.

(21) Appl. No.: 15/879,741

(22) Filed: Jan. 25, 2018

Related U.S. Application Data

(60) Provisional application No. 62/450,281, filed on Jan. 25, 2017.

(51) Int. Cl.
*E03D 9/14* (2006.01)
*E03D 1/14* (2006.01)

(52) U.S. Cl.
CPC ..... *E03D 9/14* (2013.01); *E03D 1/142* (2013.01); *E03D 2201/20* (2013.01)

(58) Field of Classification Search
CPC ..... E03D 9/14; E03D 1/142; E03D 2201/20
USPC ..... 4/345
See application file for complete search history.

(56) References Cited

U.S. PATENT DOCUMENTS 5,495,626 A * 3/1996 Lindroos ..... E03F 1/006 4/435
6,226,807 B1 * 5/2001 Rozenblatt ..... B64D 11/02 4/313
2004/0237183 A1 * 12/2004 Lindroos ..... E03F 1/006 4/431
2005/0188453 A1 * 9/2005 Miwa ..... E03D 3/00 4/425

* cited by examiner

*Primary Examiner* — Huyen D Le
(74) *Attorney, Agent, or Firm* — Kilpatrick Townsend & Stockton LLP

(57) ABSTRACT

Embodiments of the present disclosure relate generally to systems and methods for reducing sound in vacuum toilets. In one example, multiple rinse injections are used at appropriately timed intervals in order to reduce the vacuum flush sound levels.

7 Claims, 4 Drawing Sheets

MULTIPLE RINSE INJECTIONS TO REDUCE SOUND IN VACUUM TOILETS

CROSS REFERENCE TO RELATED APPLICATIONS

This application claims the benefit of U.S. Provisional Application Ser. No. 62/450,281, filed Jan. 25, 2017, titled "Multiple Rinse Injections to Reduce Sound in Vacuum Toilets," the entire contents of which are hereby incorporated by reference.

FIELD OF THE DISCLOSURE

Embodiments of the present disclosure relate generally to systems and methods for reducing sound in vacuum toilets. In one example, multiple rinse injections are used at appropriately timed intervals in order to reduce the vacuum flush sound levels.

BACKGROUND

Aircraft and other passenger transportation vehicles are often equipped with vacuum toilets in the lavatories. Although efficient, vacuum toilets tend to have a rather loud flush sound. This can be disconcerting or annoying to passengers seated near the lavatory. It is also possible to provide galley sinks with vacuum flushing capabilities in order to allow the sinks to dispose of mixed waste. Accordingly, although the features disclosed herein are equally applicable to vacuum sinks as well as vacuum toilets, the description will refer to and focus on vacuum toilets, which are more common.

Current vacuum toilets typically inject rinse water at the beginning of the flush. This causes the waste to move down in the toilet bowl, close to the exit of the bowl, allowing the vacuum to remove the waste and transport it to a holding tank during a flush. The present inventors have also found that rinse water can help reduce the spike in sound levels when the flush valve opens and/or closes to vacuum, as well as during the steady state in between opening and closing.

BRIEF SUMMARY

Embodiments of the disclosure thus provide systems and methods for reducing the level of sound associated with flush operation of vacuum-assisted toilets onboard passenger transportation vehicles. Effective utilization of the water and the rinse cycle during the flush cycle is combined with optimization of rinse delivery timing and distribution of rinse water. In one example, water is introduced at both the open and close events of the flush valve. Variables such as rinse timing, rinse length, quantity of rinse water, and otherwise managing the phasing of the rinse process has been effective in reducing sound level.

DETAILED DESCRIPTION

Embodiments of the present invention provide improved flush/rinse water delivery timing in order to reduce the sound of vacuum assisted flushing toilets and sinks. As background, the present inventors determined that a spike in sound levels occurs both at the opening and at the closing of the flush valve during a flush cycle. Altering the timing of rinse water delivery at the beginning of the flush cycle can reduce the spike in sound level. Additionally or alternatively, introducing rinse water at the closing event of the flush valve can also reduce the sound level spike that occurs at the end of the flush. Overall, managing the distribution of the rinse water over the flush cycle has the ability to reduce the sound level associated with the toilet flush.

Structure.

It is possible to incorporate one or more grey water reuse systems associated with the toilet bowl. Such grey water reuse systems can capture used grey water from hand washing at the sink level, filter, clean or otherwise condition the grey water, and re-circulate the grey water to the toilet bowl for additional rinse fluid for the flushing process.

Software/Method Changes.

Figure 1:
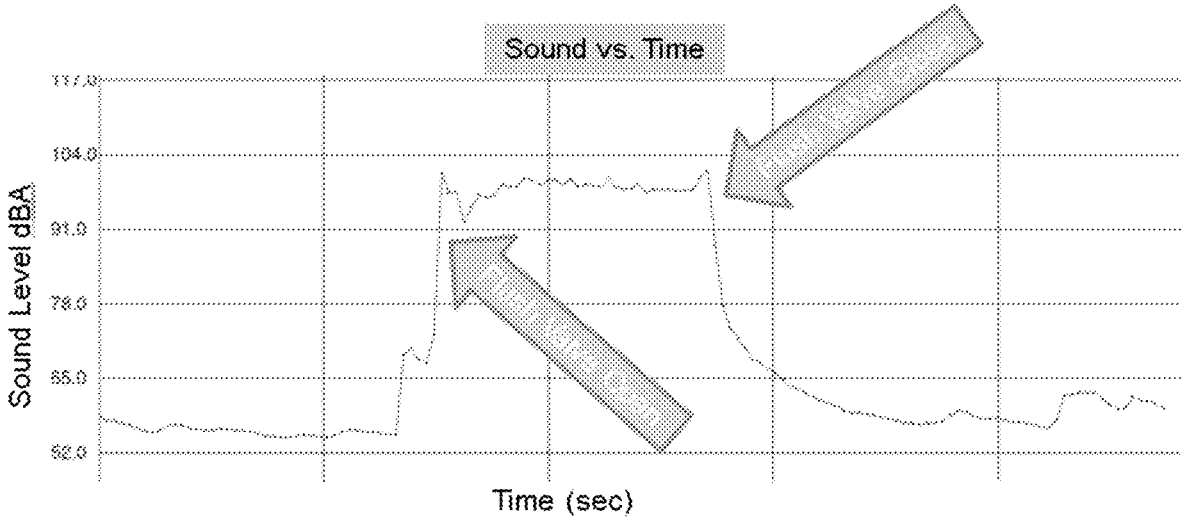
FIG. 1 shows a graph illustrating a profile of vacuum toilet sound vs. time. The open and close event have a peak in sound levels.
Figure 2:
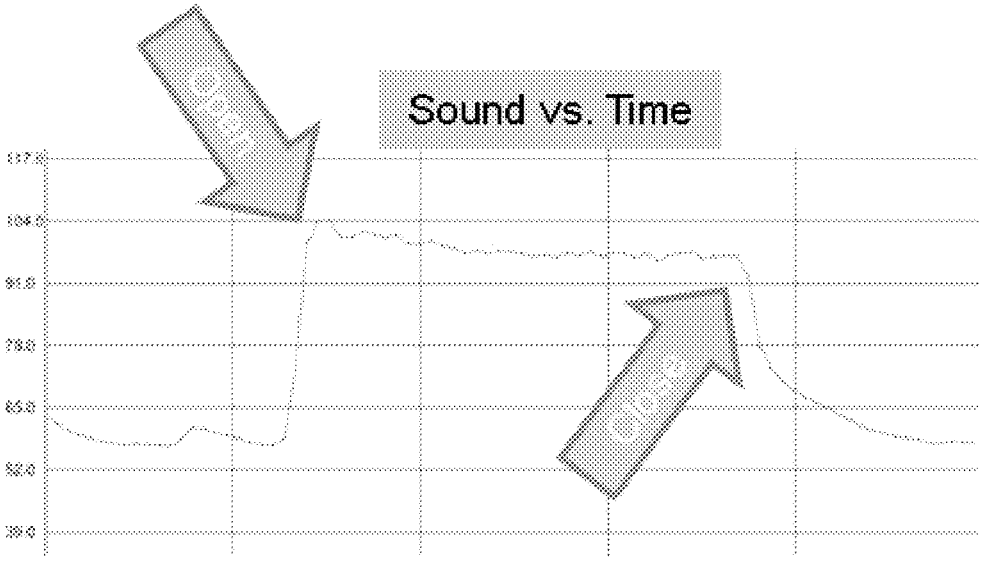
FIG. 2 shows a graph illustrating a profile of sound management when rinse water is added at the end of the flush cycle.
Figure 3:
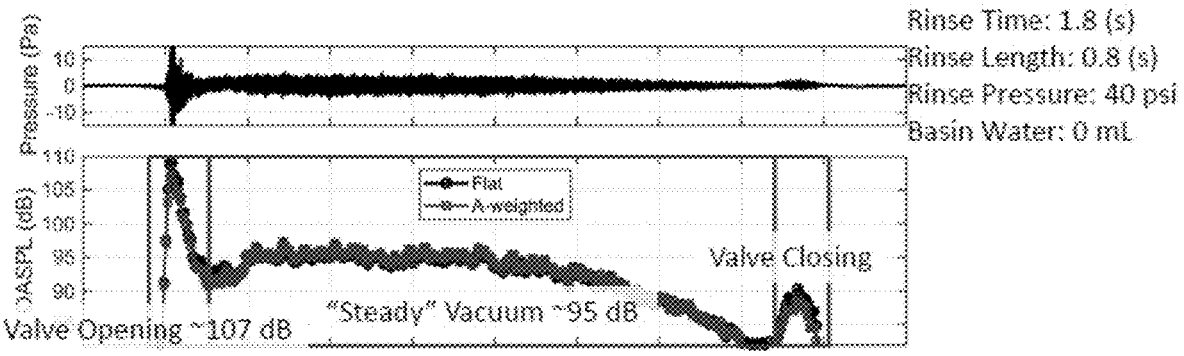
FIG. 3 is a graph illustrating a baseline flush, with a rinse time of 1.8 seconds and a rinse length of 0.8 seconds at a rinse pressure of 40 psi.
Figure 4:
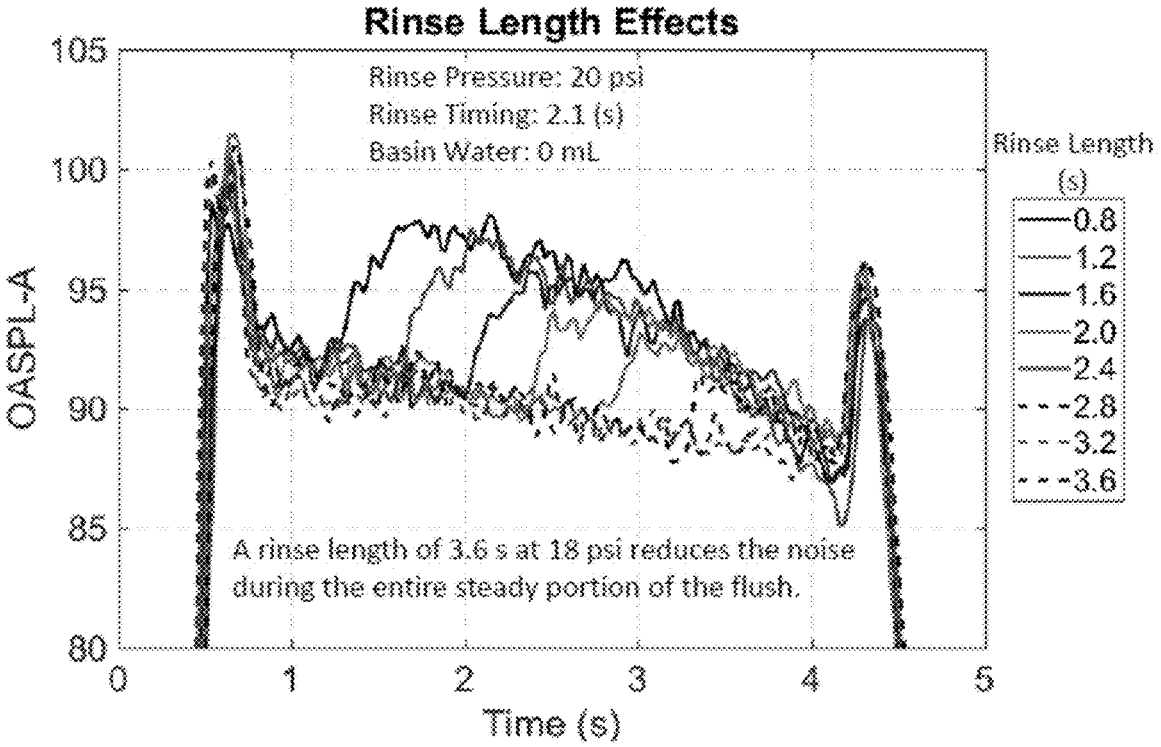
FIG. 4 is a graph illustrating various rinse length effects, showing that extended rinse lengths may help reduce sound levels.
Figure 5:
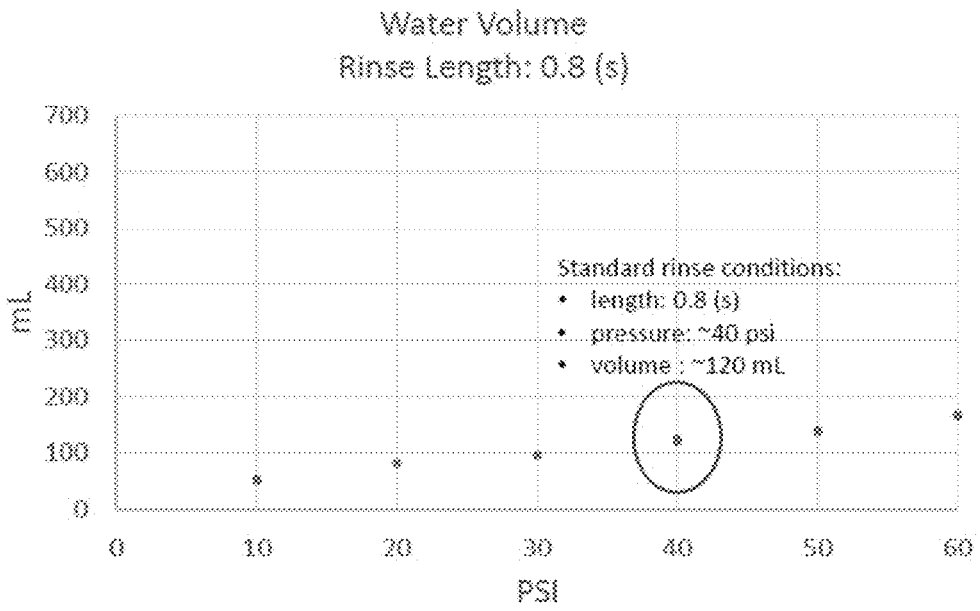
FIG. 5 is a graph illustrating a baseline rinse length.
Figure 6:
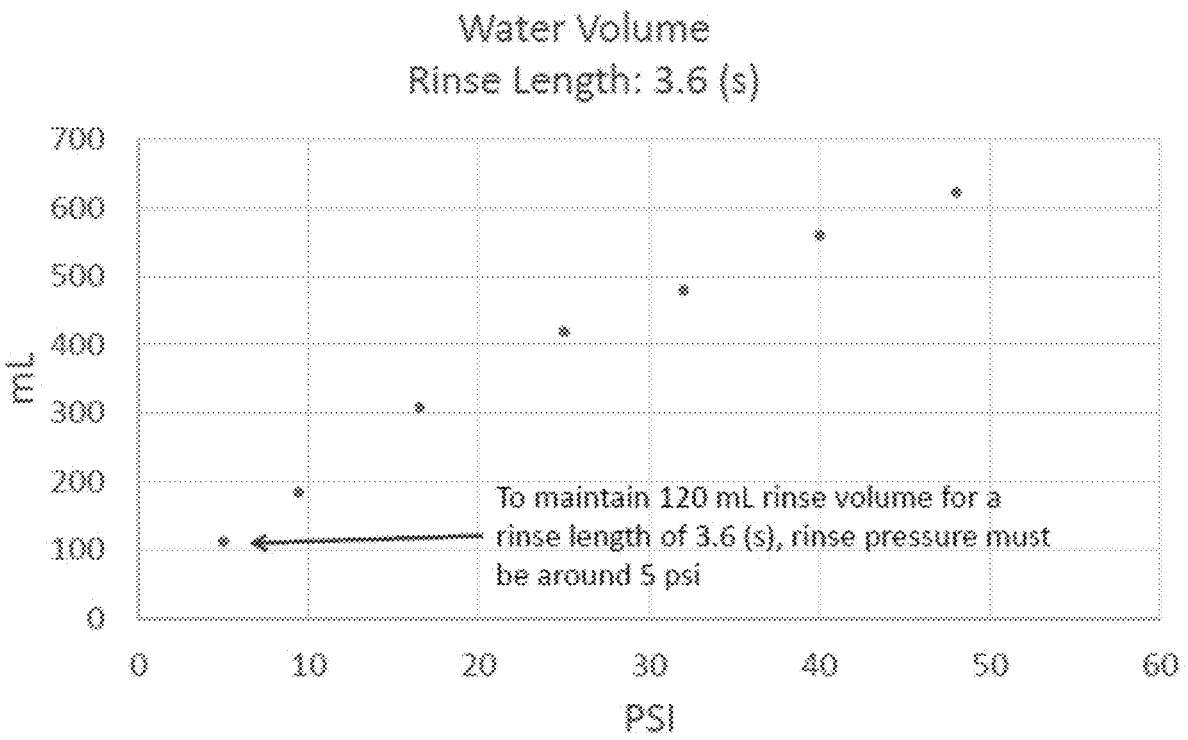
FIG. 6 is a graph illustrating extended rinse lengths, while maintaining a 120 mL rinse volume at lowered pressure.
Figure 7:
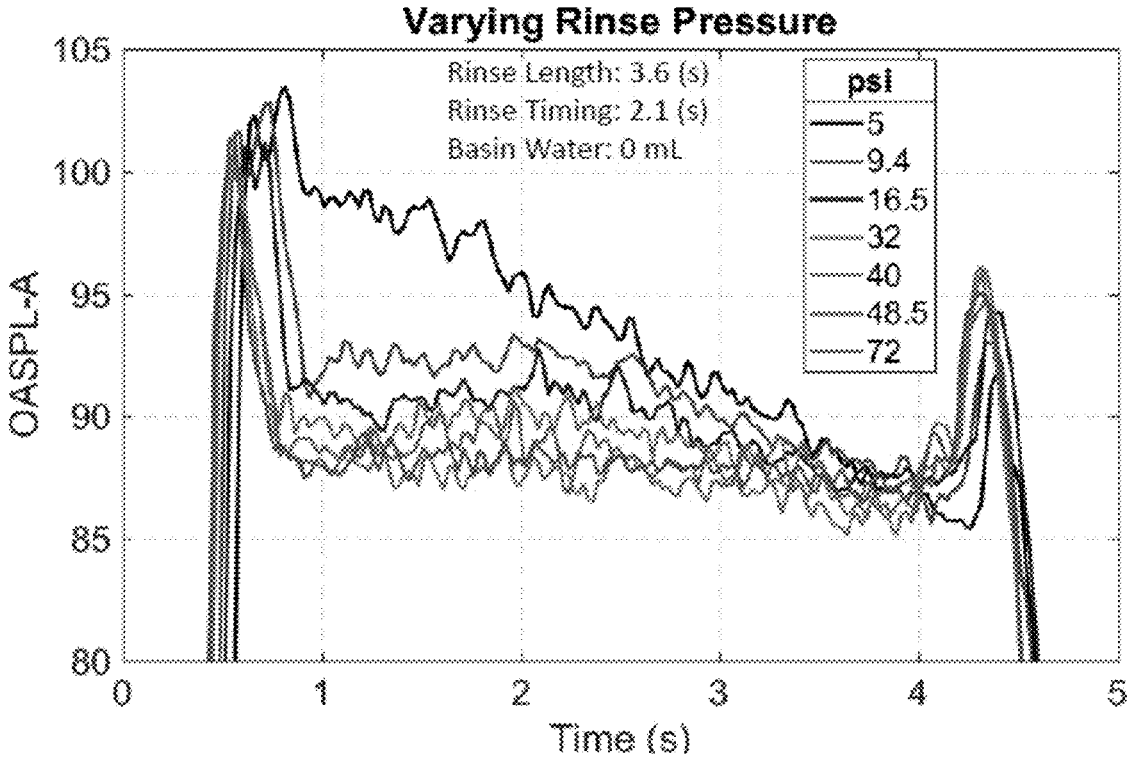
FIG. 7 is a graph illustrating various rinse pressures.
Figure 8:
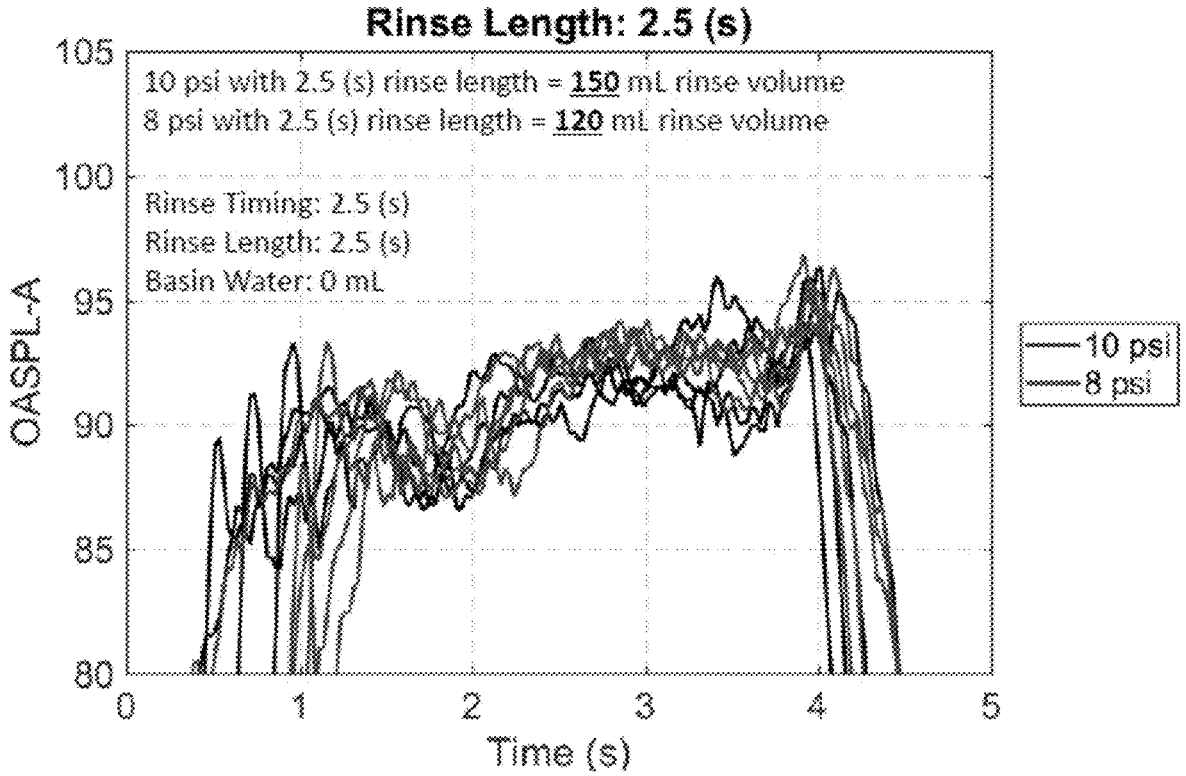
FIG. 8 is a graph illustrating various rinse lengths.

Referring now to FIGS. 1 and 2, there are three stages of the flush process. The first stage is the flush valve opening. This stage corresponds to the greatest pressure difference, and correspondingly results in the highest levels of sound. The next stage of the flush is a steady-state period, during which the flush valve is open and rinse water along with waste is being evacuated from the toilet bowl. The final stage is the flush valve closure. This stage closes off the vacuum and can also result in a spike of sound, as illustrated by FIG. 1.

A graph illustrating measured sound during a dry flush (a vacuum flush conducted without any rinse water present) illustrates a higher level of sound at both the flush valve opening, during the flush, and at flush valve closing. This shows that the presence of water is helpful in reducing sound created by the vacuum flush.

If, during the first stage of the flush valve opening, an additional amount of rinse water is delivered, this can lower the initial sound peak. Providing a greater amount of water/rinse fluid at the beginning of the flush process means that it can take longer for the rinse fluid to be cleared from toilet bowl. This can consequently help reduce some of the generated sound. The additional amount of rinse water may range anywhere from 10-20 mL up to about 500 mL. This depends upon the water capacity of the vehicle and achieving a balance between a reduced sound flush and managing water required to be carried onboard as well as using recycled water from a sink or other spent water source. In a more specific embodiment, it is envisioned that the rinse water used for the flush may range from about 100 mL to about 300 mL. This water may be delivered in one flush or it may be distributed or otherwise spread over various portions of the flush duration (e.g., 25-75 mL at the beginning of the flush and/or 25-75 mL at the end of the flush and/or 25-75 mL delivered after closure of the flush valve).

In another example, 100-125 mL may be delivered at the beginning of the flush and/or 100-125 mL may be delivered at the end of the flush. Other examples are also possible and considered within the scope of this disclosure.

This greater amount of water/rinse fluid delivered may be accomplished by injecting rinse fluid at a greater pressure in order to force more fluid into the toilet bowl. Additionally or alternatively, it may be accomplished by providing a greater number of openings in the rinse ring. Even further, additionally or alternatively, a greater amount of water/rinse fluid may be delivered by extending the amount of time that the rinse valve is open, necessarily delivering a greater amount of rinse fluid. In a specific example, the rinse valve may be allowed to remain open 1-2 seconds longer in order to provide a longer rinse time length. For example, a standard rinse length is about 0.8 seconds. It is possible to deliver the rinse fluid at the same rate as currently programmed (which is generally about 185 mL/sec, but extending the rinse length time (e.g., to between about 1.8-3.0 seconds) results in the total volume of water delivered being greater due to the longer rinse length time. Additionally or alternatively, it is possible to reduce the rinse/water pressure and extend the rinse valve opening time. This can result in using a lower amount of fluid but maintaining extended rinse water contact time in the bowl.

In another example, the opening of the rinse valve in order to deliver rinse fluid can be delayed. This can allow delivery of the same amount of rinse fluid for the same amount of time as for a current standard flush, but the delayed delivery of the rinse fluid can help minimize the flush valve opening sound. The general goal is to provide water in the flow in the region of noise generation in the waste path. In a specific example, delaying opening of the rinse valve about 0.3-0.6 seconds has been found to have a noticeable effect on sound levels.

It has been determined that there is an optimum opening point/delay for the rinse valve opening in order to help reduce or otherwise lower the sound generated. In other words, there may be provided an offset time between the onset of a flush sequence and the opening of the rinse valve.

In a further example, an additional rinse injection at the end of the flush process has been found to help lower flush sound level. For example, a late injection of rinse fluid may result in a small amount of rinse fluid remaining in the vacuum toilet after the flush valve has closed. This presence of fluid can help lower/dampen the sound of the opening of the flush valve on a subsequent flush. Similarly, it is possible to provide a pre-flush rinse. In this example, an amount of rinse fluid is delivered to the toilet bowl prior to the opening of the flush valve. The presence of fluid at the base of the bowl can help dampen the opening sound created when vacuum is first applied.

Currently, software and/or hardware controls the timing and phasing of both the flush valve and the rinse valve. Software and/or hardware changes can be implemented in order to adjust phasing between valves, number of rinse events, and water quantity delivered during each rinse by adjusting the amount of time that the rinse valve is open. In order to offset the increased amount of rinse water that may be used, it is possible to implement various grey water use technologies, as described in other co-pending applications owned by the present assignee.

Changes and modifications, additions and deletions may be made to the structures and methods recited above and shown in the drawings without departing from the scope or spirit of the disclosure or the following claims.

What is claimed is:

1. A toilet rinse cycle for a toilet system, comprising:

a toilet flush sequence that delivers more rinse fluid at a beginning of the flush sequence than is delivered at an end of the flush sequence.

2. The toilet rinse cycle of claim 1, wherein a traditional amount of rinse fluid comprises about 120 mL at a rate of 185 mL/second and wherein the more rinse fluid at the beginning of the flush sequence comprises from about an additional 10 mL to about 500 mL delivered at the beginning of the flush sequence.

3. The toilet rinse cycle of claim 1, wherein a traditional amount of rinse fluid comprises about 120 mL at a rate of 185 mL/second and wherein the more rinse fluid at the beginning of the flush sequence comprises from about an additional 100 mL to about 300 mL delivered at the beginning of the flush sequence.

4. The toilet rinse cycle of claim 1, wherein the more rinse fluid delivered at the beginning of the flush sequence is accomplished by injecting rinse fluid at a greater pressure in order to force more fluid into the toilet system.

5. The toilet rinse cycle of claim 1, wherein the more rinse fluid delivered at the beginning of the flush sequence is accomplished by providing a greater number of openings in a flush ring.

6. The toilet rinse cycle of claim 1, wherein the more rinse fluid delivered at the beginning of the flush sequence is accomplished by extending the amount of time that a rinse valve is allowed to remain open at the beginning of the flush sequence.

7. A toilet rinse cycle for a toilet system, comprising:

delaying opening of a rinse valve by about 0.3 to about 0.6 seconds upon activation of a flush sequence.

* * * * *